US009212814B2

(12) United States Patent
Puljan

(10) Patent No.: US 9,212,814 B2
(45) Date of Patent: Dec. 15, 2015

(54) BATHMATS WITH ADVANCED FEATURES

(71) Applicant: Daniel C. Puljan, Pocatello, ID (US)

(72) Inventor: Daniel C. Puljan, Pocatello, ID (US)

( * ) Notice: Subject to any disclaimer, the term of this patent is extended or adjusted under 35 U.S.C. 154(b) by 134 days.

(21) Appl. No.: 13/922,079

(22) Filed: Jun. 19, 2013

(65) Prior Publication Data

US 2014/0375434 A1 Dec. 25, 2014

(51) Int. Cl.

| | |
|---|---|
| ***G08C 19/16*** | (2006.01) |
| ***F21V 33/00*** | (2006.01) |
| ***G08C 17/02*** | (2006.01) |
| ***A47G 27/02*** | (2006.01) |
| ***G09F 13/04*** | (2006.01) |
| ***A47K 3/00*** | (2006.01) |
| *F21V 23/04* | (2006.01) |
| *F21Y 101/02* | (2006.01) |

(52) U.S. Cl.

CPC ..... *F21V 33/004* (2013.01); *A47G 27/0225* (2013.01); *A47K 3/002* (2013.01); *G08C 17/02* (2013.01); *G09F 13/04* (2013.01); *F21V 23/045* (2013.01); *F21V 23/0442* (2013.01); *F21Y 2101/02* (2013.01)

(58) Field of Classification Search

CPC ..... F21V 23/0042; F21V 2101/02; A47G 27/0225; G09F 13/04

See application file for complete search history.

(56) References Cited

U.S. PATENT DOCUMENTS

| | | | | |
|---|---|---|---|---|
| 4,544,993 | A | 10/1985 | Kirk | |
| 4,728,300 | A | 3/1988 | Shillito et al. | |
| 4,737,764 | A | 4/1988 | Harrison | |
| 5,019,950 | A | 5/1991 | Johnson | |
| 5,848,830 | A | 12/1998 | Castle et al. | |
| 6,718,576 | B1 | 4/2004 | Shih | |
| 6,773,129 | B2 | 8/2004 | Anderson, Jr. et al. | |
| 7,358,861 | B2 | 4/2008 | Blum et al. | |
| 7,670,026 | B1 | 3/2010 | Hawkins | |
| 8,388,184 | B2 | 3/2013 | Van Herpen | |
| 8,475,367 | B1 * | 7/2013 | Yuen et al. | 600/300 |
| 2007/0258255 | A1 | 11/2007 | Kessler et al. | |
| 2008/0204258 | A1 | 8/2008 | Dayton et al. | |
| 2008/0263766 | A1 * | 10/2008 | Omar | 5/417 |
| 2010/0254141 | A1 * | 10/2010 | Van Herpen | 362/249.14 |
| 2013/0077312 | A1 | 3/2013 | Van Herpen | |
| 2014/0121540 | A1 * | 5/2014 | Raskin | 600/479 |

OTHER PUBLICATIONS

Amazon.com Listing: "Papillon Light Up Bath Mat anti Slip 100 Suction Pads New + free LED spare bulbs," downloaded May 23, 2013 from http://www.amazon.co.uk/Papillon-Light-suction-spare-bulbs/dp/B009CSTK0W.

* cited by examiner

*Primary Examiner* — Kerri McNally
*Assistant Examiner* — Renee Dorsey
(74) *Attorney, Agent, or Firm* — Knobbe Martens Olson & Bear LLP

(57) ABSTRACT

Bathmats can include lights, a power source, and a computer configured to control the illumination of the lights. Several bathmat embodiments include water-resistant enclosures. Some bathmat embodiments include communication devices capable of wirelessly communicating with a computing device located remotely relative to the bathmat.

20 Claims, 10 Drawing Sheets

BATHMATS WITH ADVANCED FEATURES

BACKGROUND

1. Field

Various embodiments disclosed herein relate to mats used as floor coverings. Certain embodiments relate to bathmats located in or near bathtubs and showers.

2. Description of Related Art

Mats have been used for many years to absorb water in wet environments, provide adequate traction in slippery areas, provide cushioning, and protect flooring materials. Mats may be made from carpet, woven fabric, rubber, plastic, and many other materials.

A bathmat is one type of mat. Bathmats are often placed at the exit of bathtubs and showers. Some bathmats are designed to be placed inside a bathtub or shower to provide traction, cushioning, or increased comfort. Some bathmats are less than one inch thick, while other bathmats can be five or more inches thick.

SUMMARY

Bathmats can include lights, a power source, and a computer configured to control the illumination of the lights. Several bathmat embodiments include water-resistant enclosures. Some bathmat embodiments include communication devices capable of wirelessly communicating with a computing device located remotely relative to the bathmat.

In some embodiments, bathmats comprise a first light located inside a first water-resistant enclosure, a second light located inside a second water-resistant enclosure, and a third light located inside a third water-resistant enclosure. Bathmats can also include a controller located inside a fourth water-resistant enclosure and configured to control illumination of the lights. Some bathmats include a power source located inside a fifth water-resistant enclosure. The power source can be configured to provide electrical power to the lights, the controller, and any other electrical components. Bathmats can also include a mat configured to mechanically couple the lights, the controller, and the power source. The mat can include a substantially flat layer that is much wider and longer than it is thick. In some embodiments, the mat is between 0.2 inches and 6 inches thick. The mat can have a top surface, a bottom surface, and side surfaces.

Some bathmat embodiments comprise a pressure sensor coupled to the mat and configured to communicate with the controller. The controller can be a computer with very little or substantial computing power. Bathmats can also include multiple pressure sensors wherein each pressure sensor is configured to respond to pressure on at least a portion of the mat and to send data related to pressure to the controller. In some embodiments, bathmats are configured to sense pressure on at least thirty percent of the top surface; at least ten percent of the top surface and/or less than ninety percent of the top surface; at least fifty percent of the top surface; or at least seventy percent of the top surface.

In several embodiments, bathmats comprise a timer. Bathmats can be configured to trigger an alert if more than a predetermined time has passed. For example, the bathmat can trigger an alert if more than a predetermined time has passed since the user entered the shower, entered the bathtub, or stepped on the bathmat. The alert can comprise emitting light, sound, or haptic feedback.

In some embodiments, bathmats comprise an electrical port coupled to a mat portion of the bathmats. Electrical ports can be configured to couple the bathmat to a computing device located remotely relative to the bathmat to facilitate data transmission from the computing device to the bathmat or from the bathmat to the computing device. Some bathmats include both electrical ports and wireless communication devices, such as Bluetooth communication devices.

Although some bathmats include many distinct and separate water-resistant enclosures, some bathmats protect multiple electrical components in one water-resistant enclosure. In some embodiments, at least two, at least three, or at least five of the first water-resistant enclosure, the second water-resistant enclosure, the third water-resistant enclosure, the fourth water-resistant enclosure, and the fifth water-resistant enclosure are part of a single water-resistant enclosure.

Some bathmats consist essentially or primarily of rubber or plastic, although they comprise other components such as the electrical components discussed herein. The majority of some bathmats are made from rubber or plastic. In some embodiments, at least sixty percent and/or less than 100 percent; at least fifty percent and/or less than ninety percent; or at least seventy percent and/or less than eighty percent of the bathmat consists of rubber or plastic.

Many embodiments use diverse lighting types. In several embodiments, the first light comprises a first light-emitting diode, the second light comprises a second light-emitting diode, and the third light comprises a third light-emitting diode.

In some embodiments, a bathmat comprises a first light, a second light, and a third light in addition to a computer configured to control illumination of the lights. Bathmats can also comprise a power source configured to provide electrical power to the lights and the computer. A mat can be configured to mechanically couple the lights, the computer, and the power source. A wireless communication device can be coupled to the mat, wherein the wireless communication device can be capable of wirelessly communicating with a computing device located remotely relative to the bathmat. The wireless communicating device can be a Bluetooth device or other device that allows a bathmat to sync or communicate with a remote computing device, such as a smartphone, tablet, laptop or desktop computer. In some embodiments, the remote computing device typically does not directly touch the bathmat.

Some embodiments include software configured to be executed on the remote computing device and configured to set at least two illumination parameters of the bathmat. The illumination parameters can be lighting pattern, lighting duration, lighting intensity, which lights are illuminated, lighting timing, and/or any other lighting variable. The lighting pattern can include the way the lights are choreographed or orchestrated. In some embodiments, the lighting pattern repeats more than once. In some embodiments, the bathmat comprises at least twenty lights, at least fifty lights, at least 100 lights, or at least 5,000,000 lights.

Several bathmat embodiments include a memory with illumination patterns, wherein the illumination patterns comprise at least three phases. A phase can be one illumination state. For example, illuminating lights A and B can be phase one while illuminating lights A, D, and E can be phase two.

Some embodiments include a pressure sensor coupled to the mat. The bathmat can be configured to weigh a person who steps onto the bathmat. In some embodiments, bathmats use pressure sensors to weigh a person.

Several embodiments include one or more speakers coupled to the mat. The speakers can be oriented such that the thinnest dimension of their length, width, and thickness is oriented approximately perpendicular to the top surface of the mat. The speakers can be placed in a plastic housing to prevent the user's weight from damaging the speakers as the user walks on the bathmat.

Some embodiments include methods for controlling, configuring, and/or using a bathmat. The methods can include obtaining a bathmat that comprises a computer, a wireless communication device, and lights. Several methods include obtaining a computing device that is capable of wirelessly communicating with the bathmat and initiating wireless communication between the computing device and the bathmat. The methods can include sending data between the computing device and the bathmat. This data can be from the bathmat to the computing device and/or from the computing device to the bathmat.

Several methods include controlling at least one illumination behavior of the lights via the wireless communication. In some embodiments, the user can program illumination behavior of the lights via a graphical user interface and/or an application on the computing device. The data can comprise instructions regarding information for the bathmat to display. The information can include outside air temperature, inside air temperature, water temperature, bathtub water temperature, shower water temperature, weather forecast information, words, letters, characters, text messages, inspirational thoughts, quotes, pictures, and/or videos.

Some methods include measuring a weight of a user and sending the weight to the computing device. The computing device can track the weight over time and display the weight information to the user. The bathmat can provide weight-related alerts.

Several methods include estimating bathing time. Bathmat embodiments can alert the user if too much bathing time has passed by emitting light or sounds.

BRIEF DESCRIPTION OF THE DRAWINGS

These and other features, aspects, and advantages are described below with reference to the drawings, which are intended to illustrate but not to limit the invention. In the drawings, like reference characters denote corresponding features consistently throughout similar embodiments.

DETAILED DESCRIPTION

Several mat embodiments include advanced features as explained below. The advanced features can include electronic features, computers, and software. As used herein, bathmats include any floor covering designed to be placed in a wet environment, in water, near water, in a bathroom, near a bathtub, near a shower, in a bathtub, or in a shower. Bathmats can be washable or unwashable. Bathmats can be configured to be placed in a bathroom or in a room other than a bathroom. Some mat embodiments are configured to be placed in locations other than in a wet environment, in water, near water, in a bathroom, near a bathtub, near a shower, in a bathtub, or in a shower. Each mat embodiment can include a bathmat or a mat that is not a bathmat.

The entire contents of the following publication and patents are incorporated herein by reference: U.S. Patent Application Publication No. 2013/0077312, entitled LIGHT EMITTING TUFTED CARPET, and filed Nov. 19, 2012; U.S. Pat. No. 7,670,026, entitled NIGHT-LIGHT RUG, and filed Oct. 29, 2008; and U.S. Pat. No. 7,358,861, entitled ELECTRONIC FLOOR DISPLAY WITH ALERTING, and filed Aug. 9, 2005.

Figure 1:
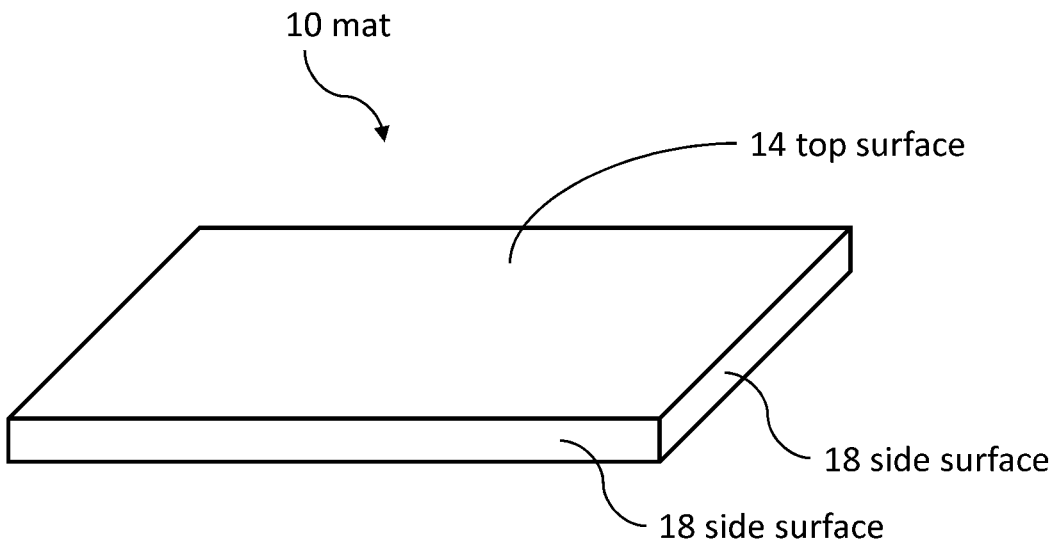
FIG. 1 illustrates a perspective view of an embodiment of a rectangular mat.

FIG. 1 illustrates a perspective view of an embodiment of a rectangular mat 10, which can be a bathmat. The mat 10 has a top surface 14 and side surfaces 18. In some embodiments, the mat 10 has a thickness of 0.1 inches to 6 inches. In many embodiments, the width and length of the mat 10 are much larger than the thickness of the mat 10.

Figure 2:
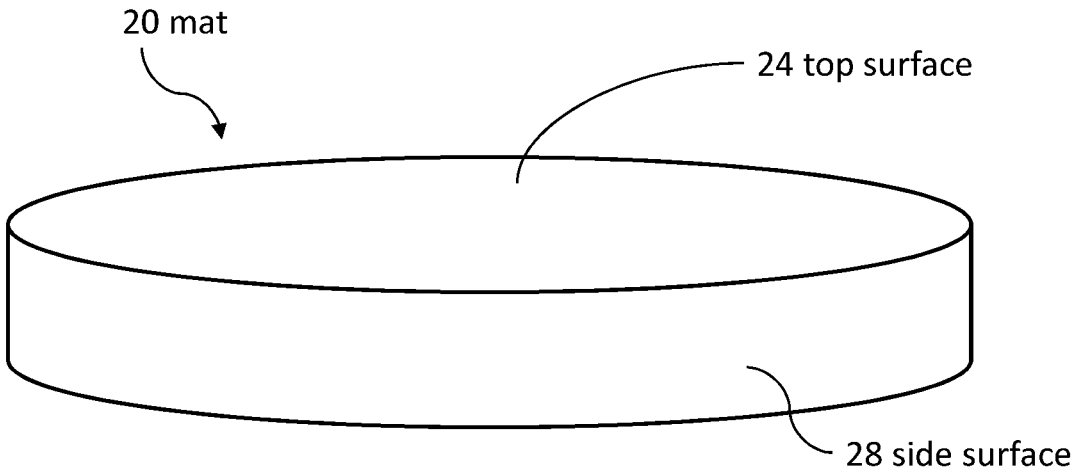
FIG. 2 illustrates a perspective view of an embodiment of an oval mat.

FIG. 2 illustrates a perspective view of an embodiment of an oval mat 20, which can be a bathmat. The mat 20 has a top surface 24, a side surface 28, and a bottom surface (not shown). The bottom surface is on the opposite side relative to the top surface 24. The mat 20 can be molded from rubber, such as a silicone with a hardness of 60 Shore A. Various electrical components can be molded into the mat 20 via overmolding processes. In some embodiments, the mat 20 is molded such that small open areas are present after molding. Light emitting diodes, electrical wires, circuitry, processors, computers, wireless communication devices, batteries, and power cord couplings can be placed into the small open areas. In some embodiments, the small open areas are then covered and/or filled with a liquid adhesive or liquid rubber that cures over time or in the presence of a curing agent to prevent water from entering the areas while the mat is used by a purchaser such as a person who uses the mat as a bathmat in a wet environment. Several embodiments use water-resistant or water-proof components.

Figure 3:
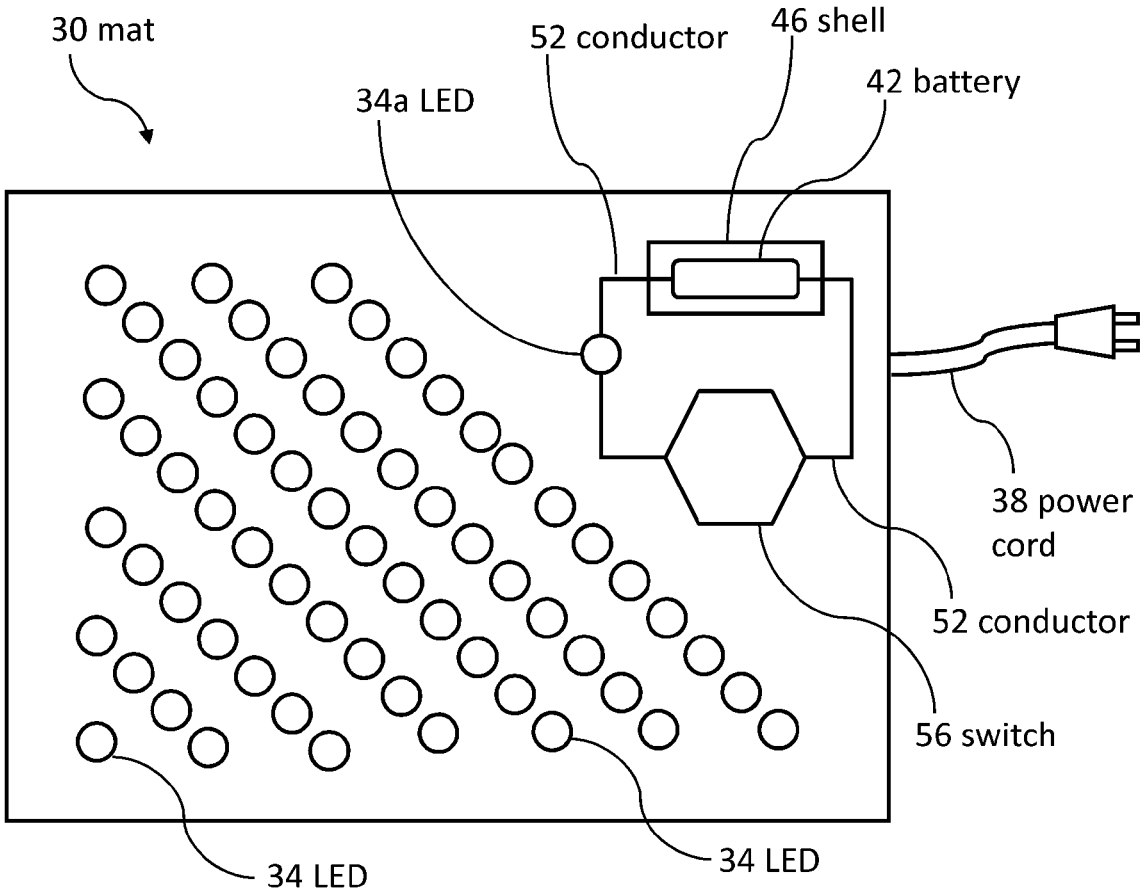
FIG. 3 illustrates a top view of an embodiment of an electrically powered mat with integrated lighting.

FIG. 3 illustrates a top view of an embodiment of an electrically powered mat 30 with integrated lighting. The lighting can include light-emitting diodes (LEDs) 34 or any other suitable light source. In the interest of clarity, only a few of the LEDs 34 are labeled in FIG. 3. The LEDs 34 in FIG. 3 are depicted as small circles. An LED can be a semiconductor light source. Some embodiments use light sources other than LEDs. Some embodiments use lights such as miniature light bulbs, incandescent bulbs, liquid crystal displays (LCDs) with liquid crystals, plasma displays such as small cells containing electrically charged ionized gases, and fluorescent lamps. Several embodiments use LCDs with LCD drivers to manage and control the data to be displayed on the mat.

The mat 30 can be made from PVC vinyl, a rubber-based material, a woven material, carpet, and/or foam. Although many portions of the mat 30 can be made from one material, the mat 30 can include many components and portions made from different materials. Some mats are configured to serve as a bathmat for use in or near a bathtub, shower, hot tub, pool, river, or lake. Some mats are used for lighting swimming pools, spas, or walkways in places such as resorts, cruise ships, movie theaters, and aircraft.

Many mat embodiments use electricity. The electricity can be supplied from a power cord 38 or a battery 42. Some embodiments include a removable power cord 38 that is used to charge the battery 42.

In some embodiments, battery-powered mats are intended for submersion in liquids such as water. Many different types of batteries can be used to power mats. Several battery embodiments include AAA batteries, AA batteries, 9V batteries, C batteries, D batteries, and/or button cell batteries.

Some battery embodiments include one or more electrochemical cells. The electrochemical cells are configured to convert chemical energy into electrical energy. The batteries can be disposable (such as single-use batteries) or rechargeable. Some embodiments use nickel-metal-hydride batteries, zinc-carbon batteries, zinc-chloride batteries, silver-oxide batteries, or lithium batteries.

The battery-housing compartment can have an impact resistant shell 46, which can be 0.05 inch to 0.3 inch thick plastic. The shell 46 can be waterproof due to the impermeability of the shell material and the presence of a rubber ring integrated into the shell's lid. When the lid closes and latches shut, the lid presses the rubber ring against the base of the shell, which forms a water-tight enclosure that generally prevents water from leaking from a wet environment, such as a bathroom floor, into the inside of the shell 46. The shell 46 can be configured to enclose the battery 42. The shell 46 can include electrical connections that enable the battery to be electrically coupled to LEDs 34 and other components that need electrical power.

The shell 46 can include a sliding clip that allows for battery removal from the battery housing. The location of the battery-housing compartment may vary. In some embodiments, the battery-housing compartment, which can be a shell 46, can reside near the perimeter of the mat. The location of the batteries within the shell 46 may vary. Various embodiments include diverse battery layouts and configurations. If more than one battery is utilized, the batteries can be installed side-by-side and/or stacked.

A switch 56 controls the flow of electricity from the battery 42 through conductors 52 and to an LED 34*a*. The switch 56 may be a foot switch configured to interrupt the electrical current until a person steps on the switch 56. Although FIG. 3 illustrates the switch 56 controlling just one LED 34*a* to increase the clarity of FIG. 3, some embodiments include a switch 56 that controls several LEDs 34. In several embodiments, a switch 56 covers a majority of a mat 30. When a person steps on the switch 56, all or several of the LEDs 34 emit light. The switch 56 can be a pressure switch that closes an electrical circuit when a person steps on the switch.

Figure 4:
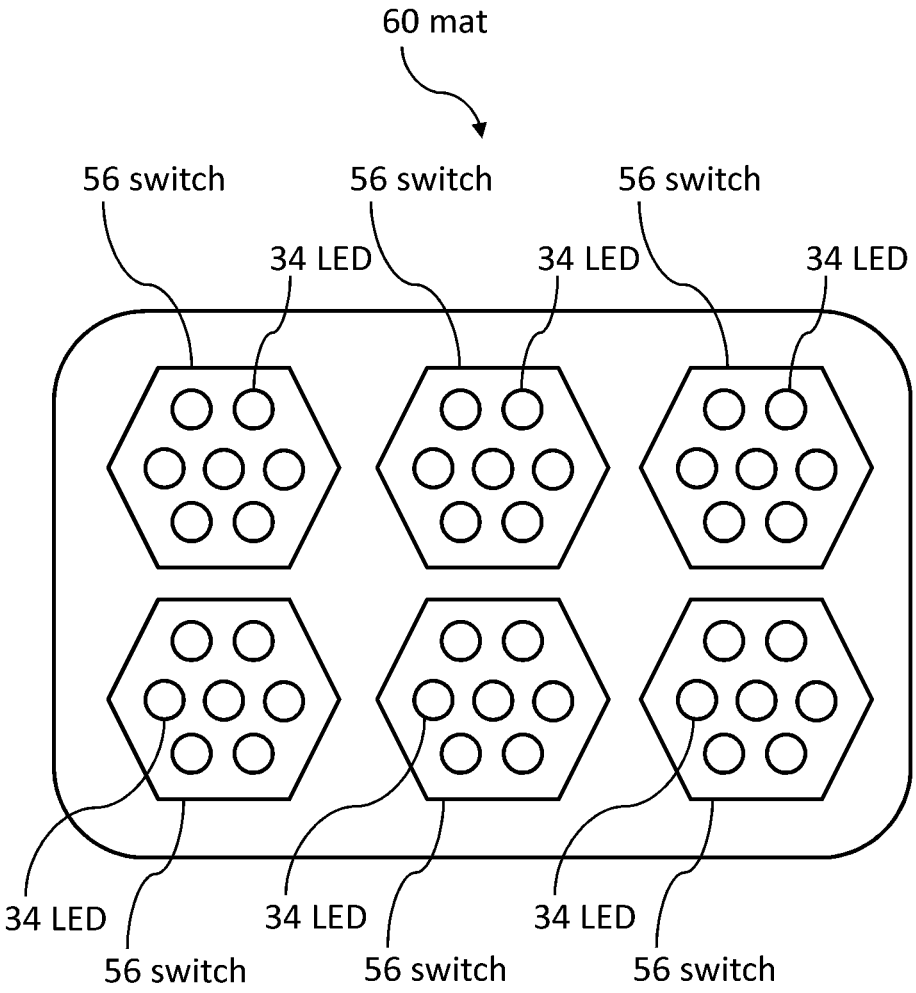
FIG. 4 illustrates a top view of a mat that includes switches, according to one embodiment.

FIG. 4 illustrates a top view of another mat embodiment 60 that includes switches 56. In this embodiment, stepping on a switch 56 causes the LEDs 34 located within the perimeter of the switch 56 to illuminate. In some embodiments, stepping on a switch, compressing a switch, or triggering a pressure sensitive switch causes at least three LEDs to illuminate. The LEDs that illuminate in response to a switch can be electrically coupled to that switch.

Some mat embodiments include at least two switches. Each switch is configured to control the flow of electricity to at least two lights. Several mat embodiments include a first area, a second area, and a third area. Each area includes a switch that is configured to control the flow of electricity to at least three lights. The embodiment illustrated in FIG. 4 includes six areas, wherein each area includes at least seven lights.

The LEDs 34 can flash for a certain period of time or can constantly emit light for a certain period of time. The LEDs 34 can automatically stop emitting light after a certain time has passed since the user stepped on the corresponding switch 56. Each area of the mat 60 can include LEDs 34 that emit a different color of light. In the interest of clarity, only a few of the LEDs 34 are labeled in FIG. 4. The LEDs 34 in FIG. 4 are depicted as small circles.

The dimensions of mat embodiments vary dramatically. Sizes may vary depending on the application of the product. Some embodiments include mats with dimensions of 12 inches by 12 inches, 16 inches by 27 inches, and 10 feet by 35 feet. Several round and square mat embodiments include a largest dimension between one foot and fifteen feet.

Mat embodiments include diverse shapes. The sides of mats may be straight, curved, or wavy. Embodiments include mats of many different shapes including squares, rectangles, circles, ovals, stars, and animal shapes.

Several mat embodiments include suction cups to aid in the adhesion or coupling of the mats to the surface of a floor, tile, vinyl, bathtub, shower, pool, or spa. The mats can have strips of raised rubber that act as a non-slip surface. Some embodiments of mats that are not configured to be submerged have surface features such as bumps, raised rubber strips, or divots that act as a non-slip surface.

Several mat embodiments include a top surface that is smooth. Some top surface embodiments include raised areas in the form of partial bubbles, wavy lines, or other shapes such as squares, diamonds, or many other diverse shapes. In some embodiments, the purpose of the raised surfaces on the top of the mat is to produce a non-slip surface.

The top of the mat can also include of a massaging surface. For example, the top surface can include a series of nodules, bumps, or protrusions covering at least a portion of the top surface that can act to massage a person's feet when the person is standing on the nodules. In some embodiments, the LEDs illuminate as the user rubs and/or touches the massaging surface.

Some mat embodiments are generally clear, transparent, and/or translucent. Several mat embodiments are clear, transparent, and/or translucent but include a slight color.

Several mat embodiments have holes incorporated into the surface structure that allow for the draining of liquids through the mat to reduce pooling of the liquids. These embodiments can be particularly well suited for mats that are sometimes submerged and/or experience direct contact with substantial amounts of liquid. In some embodiments, the holes range in diameter from 0.05 inches to 1.5 inches. In several embodiments, the holes are approximately 0.25 inches wide.

Figure 5:
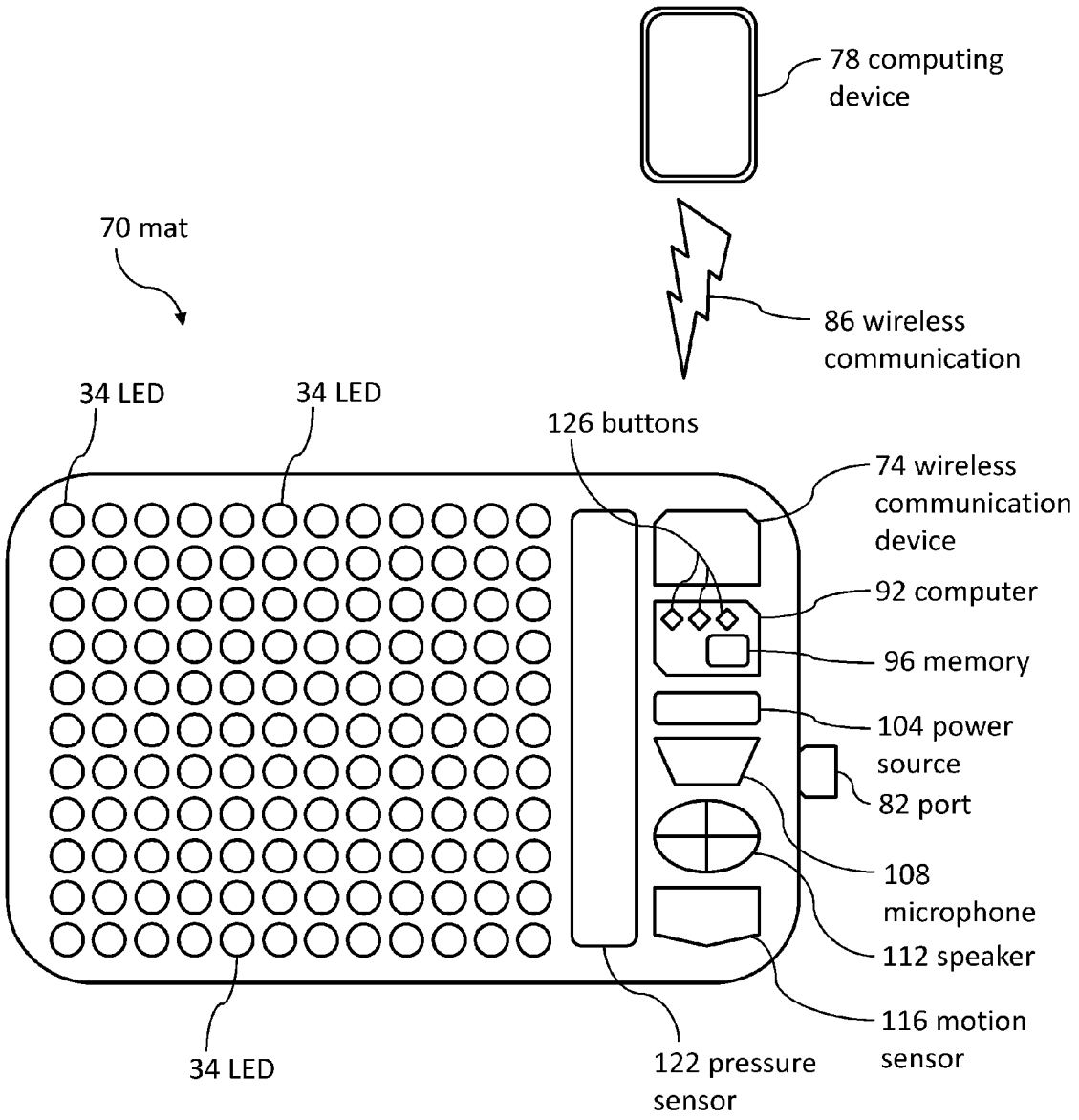
FIG. 5 illustrates a top view of a mat embodiment.

FIG. 5 illustrates a top view of a mat embodiment 70. In the interest of clarity, only a few of the LEDs 34 are labeled in FIG. 5. The LEDs 34 in FIG. 5 are depicted as small circles. Not all of the LEDs 34 in mat 70 are shown in the illustration to increase the clarity of other components and assemblies. Some mat embodiments include at least 10 LEDs, at least 25 LEDs, at least 100 LEDs, or at least 400 LEDs.

Several components and assemblies are not shown in FIG. 5 to increase the clarity of the illustrated components and assemblies. For example, electrical conductors (such as wires and cables), electrical interconnects, and circuit boards with electronic components are not shown in FIG. 5.

Several embodiments are similar to the embodiment illustrated in FIG. 5 except the LEDs are replaced with any other light source, display technology, and/or display means. Some embodiments are similar to the embodiment illustrated in FIG. 5 except that the embodiments include liquid crystal displays (LCDs) with liquid crystals.

Figure 10:
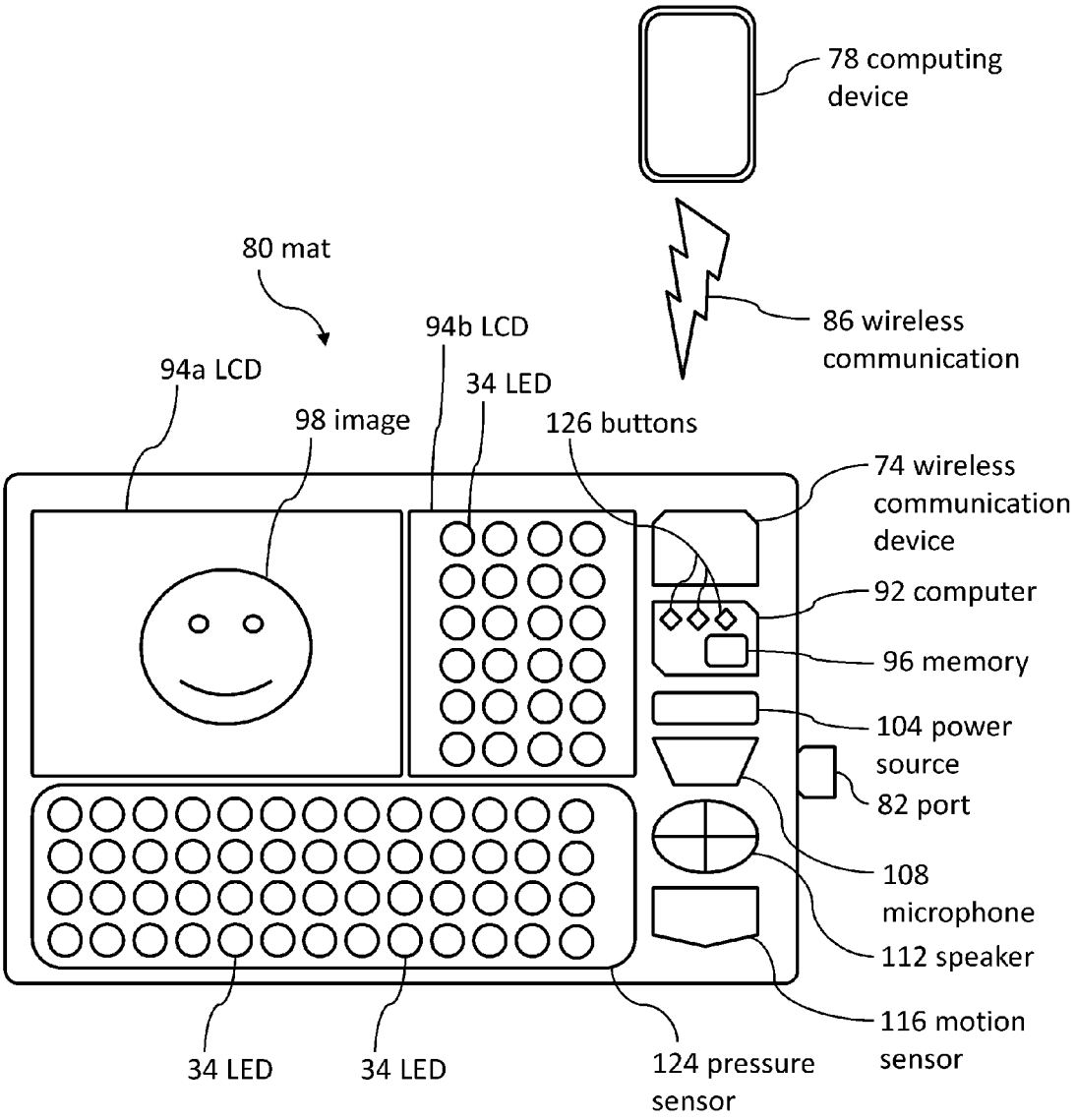
FIG. 10 illustrates a top view of a mat embodiment.

FIG. 10 illustrates a top view of a mat embodiment. The mat 80 in FIG. 10 can be a bathmat with many water-resistant enclosures. The mat 80 is similar to the embodiment illustrated in FIG. 5 except that the mat 80 includes liquid crystal displays (LCDs) 94*a*, 94*b* with liquid crystals. Several mat embodiments include other types of displays, such as plasma displays, which can show electronic pictures and videos.

The LCDs 94*a*, 94*b* can be used to display an image 98 such as a high-resolution picture of a person, animal, or landscape. The image 98 can be a moving image such that the mat 80 can display videos and movies. The LCDs 94*a*, 94*b* can be placed in a water-resistant enclosure such as the water-resistant enclosures 132 shown in FIG. 7. Some embodiments include LCDs or other displays that are approximately four inches by seven inches, but other embodiments can include displays of other sizes. The mat 80 can also include LEDs 34 located to the side of the LCD 94*a* or below the LCD 94*a*. Not all of the LEDs 34 are labeled in FIG. 10 to increase the overall clarity of FIG. 10. In some embodiments, LEDs 34 or other lights are located below or integrated into the LCD 94*b*.

As discussed in other embodiments, pressure sensors 124 can cover and/or interact with a large portion of bathmats. In some embodiments, LEDs 34 or other lights can be located in the same area as pressure sensors 124, over pressure sensors 124, or under pressure sensors 124. In several embodiments, the pressure sensor 124 has a footprint, which is the portion of the top surface (of the mat) under which the pressure sensor 124 resides. One or more lights, such as LEDs 34, can be located in the pressure sensor's footprint or under the pressure sensor's footprint such that moving from the top surface to the bottom surface of a mat in a direction perpendicular to the top surface could cause a virtual probe to pass through an LED and a pressure sensor even if the LED and the pressure sensor are not located in the same plane.

Figure 11:
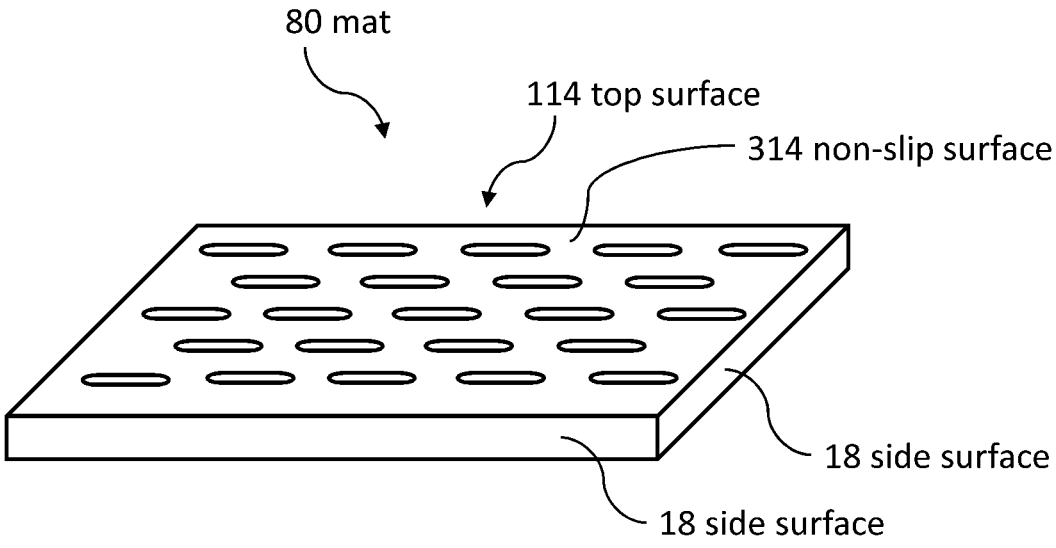
FIGS. 11 and 12 illustrate perspective views of the mat embodiment illustrated in FIG. 10.
Figure 12:
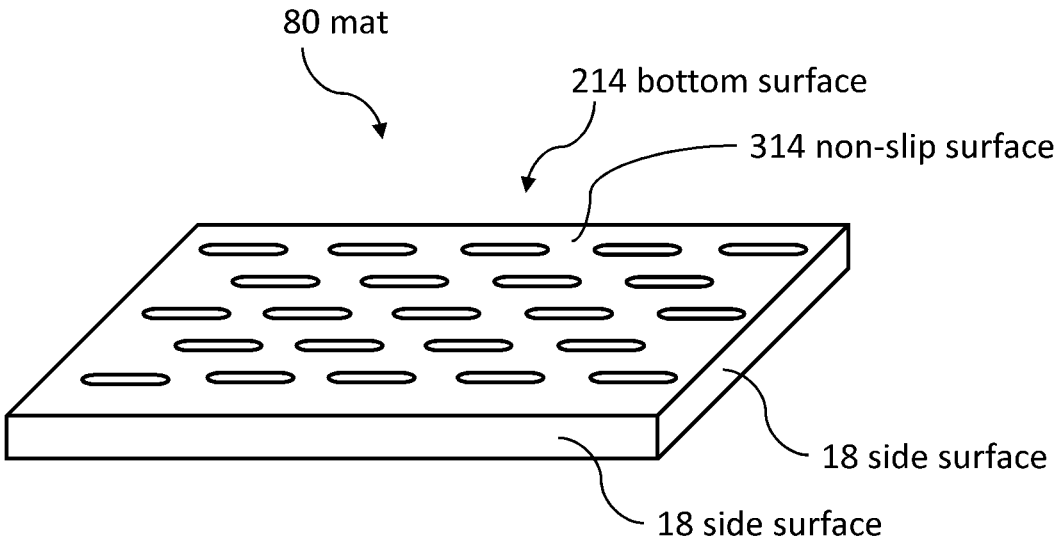

FIGS. 11 and 12 illustrate perspective views of the mat embodiment 80 illustrated in FIG. 10. In several embodiments, mats are configured to be placed on the floor. The bottom surface 214 and the top surface 114 of the mat 80 can include a non-slip surface 314, which is a surface configured to reduce the likelihood of the mat sliding and/or of a person sliding on the mat. The non-slip surface 314 can include bumps and high-friction materials such as rubber.

Referring now to FIG. 5, the mat 70 can include a wireless communication device 74 to communicate wirelessly with a computing device 78 that can be located remotely from the mat 70. The computing device 78 can be a computer, cellular phone, smart phone, laptop computer, tablet computer, desktop computer, or any other suitable device configured to execute computer instructions. In some embodiments, the computing device 78 is an iPhone, iPad, iMac, MacBook Air, or MacBook Pro made by Apple Inc. The computing device 78 can include an application and/or software that allows a user to control many features and behaviors of the mat 70.

The wireless communication device 74 can use many wireless communication means, systems, and protocols to facilitate and/or enable wireless communication 86 between the computing device 78 and the mat 70. The wireless communication 86 can include the following communication means: radio, WiFi (e.g., wireless local area network), cellular, Bluetooth, electromagnetic, infrared, light, sonic, and microwave. Other communication means are used by some mat embodiments.

Some mat embodiments include means to connect a wire or cable between the mat 70 and the computing device 78 to enable the computing device 78 to communicate with the mat 70. This communication can be one way or two way. Some mat embodiments include a port 82 such as a Universal Serial Bus (USB) port, Ethernet port, IEEE 1394 interface port (e.g., FireWire port made by Apple Inc.), parallel port, serial port, PS/2 port (e.g., a 6-pin Mini-DIN connector), Video Graphics Array (VGA) port, digital visual interface port, Small Computer System Interface (SCSI) port, High-Definition Multimedia Interface (HDMI) port, minijack port, Thunderbolt port made by Apple Inc., or any other port that enables wired communication between the computing device 78 and the mat 70. In some embodiments, a cable is coupled between the computing device 78 and the mat 70 to facilitate and/or enable data transfer and/or communication between the mat 70 and the computing device 78. Some embodiments use both wired and wireless communication.

In some embodiments, a portable data storage device such as a flash drive, solid-state drive, or memory stick is plugged into the port 82. The portable data storage device can be used to deliver data and/or software to the mat and/or can be used to transport data collected and/or generated by the mat to a remotely located computing device. The remotely located computing device can be any computing device that is not coupled to the mat by a physical connection.

The port 82 and/or the wireless communication device 74 can be electrically connected to a computer 92. The computer 92 can be located inside at least a portion of the mat 70. In some embodiments, the computer 92 is coupled to the mat 70.

The computer 92 that is coupled to the mat 70 can be a very simple computer because many mat embodiments require very little computational power and/or memory. The computer 92 can be any device configured to execute computer instructions, code modules, and/or software. In some embodiments, the computer 92 includes a memory 96 such as a hard drive, solid state memory, flash memory, optical disk, or the like. Some computer embodiments use transitory computer readable storage media. The computer 92 may implement processes and algorithms partially or wholly in application-specific circuitry. In some embodiments, the computer 92 is a controller configured to control the illumination of the mat's lights.

Some embodiments include using the mat 70 to collect data and/or take measurements. The results of the disclosed processes and process steps may be stored, persistently or otherwise, in any type of non-transitory computer storage such as, e.g., volatile or non-volatile storage. As discussed previously, a power source 104, such as a battery or a power cord that plugs into an electrical outlet, can be used to provide electricity to all mat components that need electricity.

Some mat embodiments include a microphone 108. The microphone 108 can be configured to listen for spoken commands from a user. For example, the user can tell the mat 70 to display a particular illumination pattern or illumination mode. The microphone 108 can also sense characteristics of sound and then use those characteristics to alter light display characteristics. For example, in some embodiments, the mat 70 pulses light according to the beat of music and/or varies the illumination pattern or mode according to the music. Like other electrical components, the microphone 108 can be placed in a water-resistant housing or enclosure.

Several mat embodiments include at least one speaker 112. The speaker 112 can provide audio data to the user and can play music. In some embodiments, the mat 70 greets a user with spoken words or music when the mat 70 senses and/or determines that the user is present.

Some bathmat embodiments wirelessly receive music data from a computing device such as an MP3 player. The mat can play the music via its speaker 112. In some embodiments, the user presses buttons on the mat to control the music (e.g., pause, play, song selection, volume control).

In some embodiments, the mat's illumination is responsive to the music. For example, the illumination of the mat 70 can pulse to the music, increase in intensity based on the volume of the music, or dance to the music.

Several mat embodiments have the ability to sync via Bluetooth to an electronic device such as a stereo or smartphone. When the mat is in sync with such a device, a modulator can allow the mat to pulse light in various colors, intensities, and patterns to any given selection of music.

Some mat embodiments include a motion sensor 116. The motion sensor 116 can be used to detect when a person is close to the mat 70. Once the mat 70 determines that a person is close to the mat 70, the mat 70 can respond by providing light therapy, games, music, and/or greetings. For example, in some embodiments, the computer 92 includes a clock. The mat 70 can greet a person with a time-appropriate greeting or message such as "good morning" or "good afternoon." In some embodiments, the user can program greetings or other settings by using an application run by the computing device 78.

The motion sensor 116 can be any type of motion detector. The motion sensor 116 can be a passive infrared motion detector, an ultrasonic motion detector, a microwave motion detector, or a tomographic motion detector. Some motion sensors 116 use a combination of motion detection technologies.

In several embodiments, the mat 70 detects a person by using pressure sensors. For example, when a person steps on a pressure sensor, the mat 70 knows a person is present. The mat 70 can then respond with light therapy, games, music, and/or greetings. In some embodiments, the mat 70 responds with messages written on a display, which can comprise the LEDs 34 of the mat 70.

Several mat embodiments include a pressure sensor 122. Some pressure sensors generate a signal that is a function of the pressure on the sensor. Several embodiments use piezometers, piezoresistive strain gauges, and/or piezoelectric materials to measure pressure. Some embodiments use capacitive, electromagnetic, optical, resistive, and/or potentiometer sensors to measure pressure and/or force. Pressure measurements combined with data regarding the area on which the pressure acts can be used to determine force. Thus, some mat embodiments act as a scale and/or include a scale to weigh users.

In some embodiments, pressure sensors are calibrated to yield force or weight data. Mat embodiments with pressure sensors 122 or other suitable sensors can be used to enable the mats to measure the weight of the person on the mat. The user's weight data can be tracked over time. The weight data can be sent to the computing device 78. The computing device 78 can display historical weight data to the user.

In some cases, multiple people will use one mat. For example, multiple people might use one bathroom. Although the pressure sensor 122 in FIG. 5 is illustrated as a narrow strip, it can cover or be under a majority of the top surface of the mat 70. In some embodiments, the mat 70 can distinguish one individual from another individual based on the footprint of each individual.

For example, the mat 70 can calculate the area of each individual's footprint based on the area that experiences pressure that is greater than ambient pressure. In some embodiments, the mat 70 can calculate the area of each individual's footprint based on the area that experiences pressure that is at least 1 pound per square inch, at least 2 pounds per square inch, or at least 4 pounds per square inch greater than ambient pressure. In some embodiments, ambient pressure is atmospheric pressure. Thus, the mat 7 can distinguish one individual from another individual based on the area of the footprint of each individual.

The mat 70 can assign weight measurements to the individual with the footprint area that correlates with the footprint area of the user who is currently on the mat 70. For example, if user one has a footprint area of approximately 14 square inches and user two has a footprint area of approximately 24 square inches, then the mat 70 can assign all weight measurements calculated, determined, and/or sensed when the footprint area was approximately 14 inches to user one and the mat 70 can assign all weight measurements calculated, determined, and/or sensed when the footprint area was approximately 24 inches to user two.

In some embodiments, the mat 70 provides a first type of feedback if the user has gained weight since the last recorded measurement and provides a second type of feedback if the user has lost weight since the last recorded measurement. The first type of feedback can be flashing red lights, a first type of music, and/or an alarm sound. The second type of feedback can be flashing green lights, a second type of music, and/or a positive sound.

Figure 6:
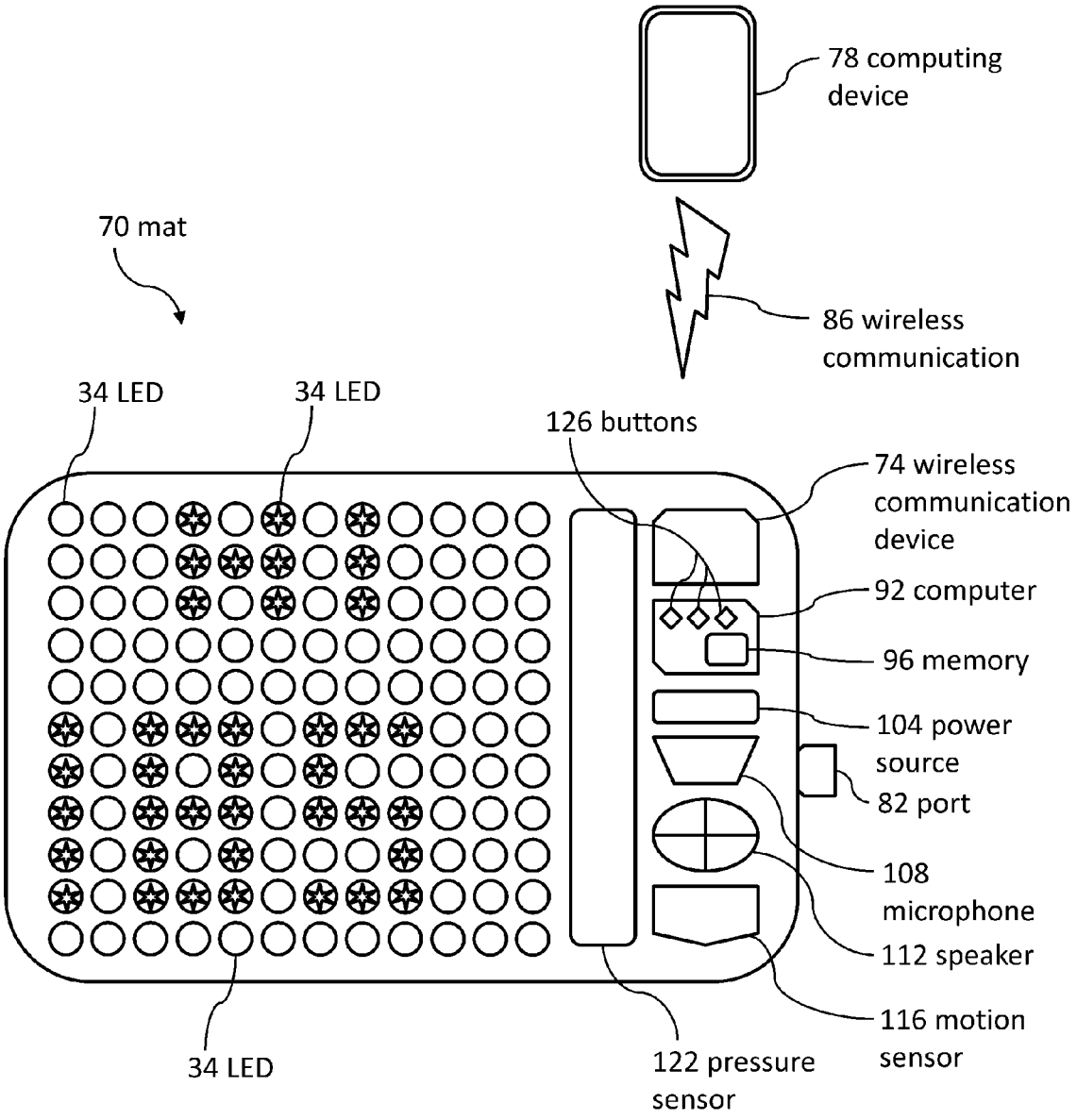
FIGS. 6 and 7 illustrate top views of the embodiment illustrated in FIG. 5.

FIG. 6 illustrates a top view of the embodiment illustrated in FIG. 5. In FIG. 6 some of the LEDs 34 are emitting light. The LEDs 34 or other display means can display characters, letters, numbers, shapes, videos, pictures, and patterns. In some embodiments, the mat 70 displays the time, outside temperature, inside temperature, text messages, to-do list, news headlines, inspirational thoughts, or any other information stored in the mat 70 or provided by the computing device 78. In some embodiments, the mat 70 displays the amount of time the user was in the shower, bathtub, or bathroom.

In some embodiments, the mat 70 illuminates where the user is currently stepping or has recently stepped. In several embodiments, the mat 70 illuminates where the user is currently stepping and/or has stepped within at least 60 seconds; where the user has stepped within at least 3 minutes; where the user has stepped more than 5 seconds and/or less than 15 minutes in the past; or where the user has stepped more than 1 second and/or less than 60 minutes in the past. The illumination can approximate the shape of the user's footprints.

In some embodiments, the mat 70 provides learning games and/or lessons. For example, the mat 70 can display a picture and several answers. The user has to touch the correct answer. The picture may be of an object and the answer may be the letters with which the name of the object starts. The picture can show a certain number of items and the answer may be the number of the items shown. The mat 70 can also show shapes with which the user can interact.

The computing device 78 can be used to control and/or program the mat 70. For example, the computing device 78 can be used to choose what illumination patterns or pictures are shown on the mat 70. In some embodiments, the user designs the illumination experience shown on the mat 70 by using an application and/or software on the computing device 78. The user can select or design artwork patterns to be displayed on the mat 70.

In several embodiments, control of the color, intensity of color, and pattern in which the lights are activated can be managed by a circuit board and modulating dial, which can be located on the mat 70. In some embodiments, the mat 70 includes input buttons 126 that allow a user to select display modes, illumination patterns, illumination color, and other settings as described elsewhere herein. In some embodiments, the circuit board and/or light-modulating dial can be built into the battery-housing unit or can be adjacent to the battery-housing unit.

Several embodiments include lights with color changing capability. This color changing capability can also coincide with various pre-programmed patterns in which the lights are activated.

The varying modes, such as pressure sense mode, music sync mode, or general light emission mode, can all be regulated via a selector dial, buttons 126, or the computing device 78. In some embodiments, the computing device 78 is a smartphone that wirelessly communicates with a bathmat via Bluetooth.

Various mat embodiments include a perimeter of lighting devices or elements. Some mat embodiments include lighting strips. Several rectangular mat embodiments and oval mat embodiments include perimeter lighting and lighting strips. Some embodiments include spiraling lights. For example, a round bathmat can include spiraling lights that change color and brightness according to the selected mode, music, sensed pressure, and/or motion of the user. Several mat embodiments display zig-zag illumination patterns.

Some mat embodiments sense the mood of the user and then provide appropriate light therapy, displayed messages, or music. In some embodiments, the mat senses the mood of the user based on how quickly the user moves on the mat.

Some mat embodiments provide appropriate light therapy, displayed messages, or music based on the time of the day. For example, bright lights are sometimes more appropriate in the morning to help make the user more alert while soothing lights, such as dimmer lights or blue lights, might be more appropriate as the user gets ready for bed.

In some embodiments, mats are responsive to the user's touch. These embodiments enable games such as Whac-A-Mole by Creative Engineering, Inc. and virtual ping-pong. As mentioned previously, the mat can be pressure sensitive. For example, various mat embodiments include a pressure-sensitive core layer that can allow for the activation of groups of lights in different areas of the mat when pressure is applied to that area. In some embodiments, the mat is used as a controller for games displayed on the computing device 78.

In several embodiments, the lights serve an alarm function by alerting the user to potential problems such as a mat that is unclean, contaminated, old, or slippery.

Some bathmat embodiments help to conserve water and/or encourage people to hurry in the bathroom by alerting people if they spend too much time in the bathtub, shower, or bathroom. For example, when a person initially steps on a bathmat, the bathmat can begin a timer. Some bathmats are configured to display how much time has passed since the person initially stepped on the bathmat.

Some bathmats are configured to trigger an alert if more than a predetermined time has passed. The predetermined amount of time can be at least 5 minutes and/or less than 60 minutes; at least 10 minutes and/or less than 30 minutes; or at least 15 minutes and/or less than 25 minutes. The alert can comprise the bathmat emitting light, sounds, or haptic feedback, such as vibrations that the user can feel in her feet. Light alerts can include flashing lights, pulsing lights, and/or light patterns.

Some bathmat embodiments display how much water a person has used during a particular shower or bath. Some bathmat embodiments display how much water a person has used cumulatively over a certain period of time such as one week, one month, or one year. The bathmat can send water usage data to a remote computing device, which can record, graph, and/or display the water usage data.

In some embodiments, the mat uses pressure sensors to determine when the user has stepped from the mat towards the shower or bathtub. This action can start a timer. When the user steps back onto the mat, the mat senses the user and can stop the timer. This bathing time can be correlated with water usage based on the gallons per minute of a typical shower, on the gallons per minute of the actual shower, or on an estimate of how much water is typically used by a bathtub. In some cases, the mat can flash one color if the user was in the shower for an appropriate amount of time and can flash another color if the user was in the shower for too long.

Figure 7:
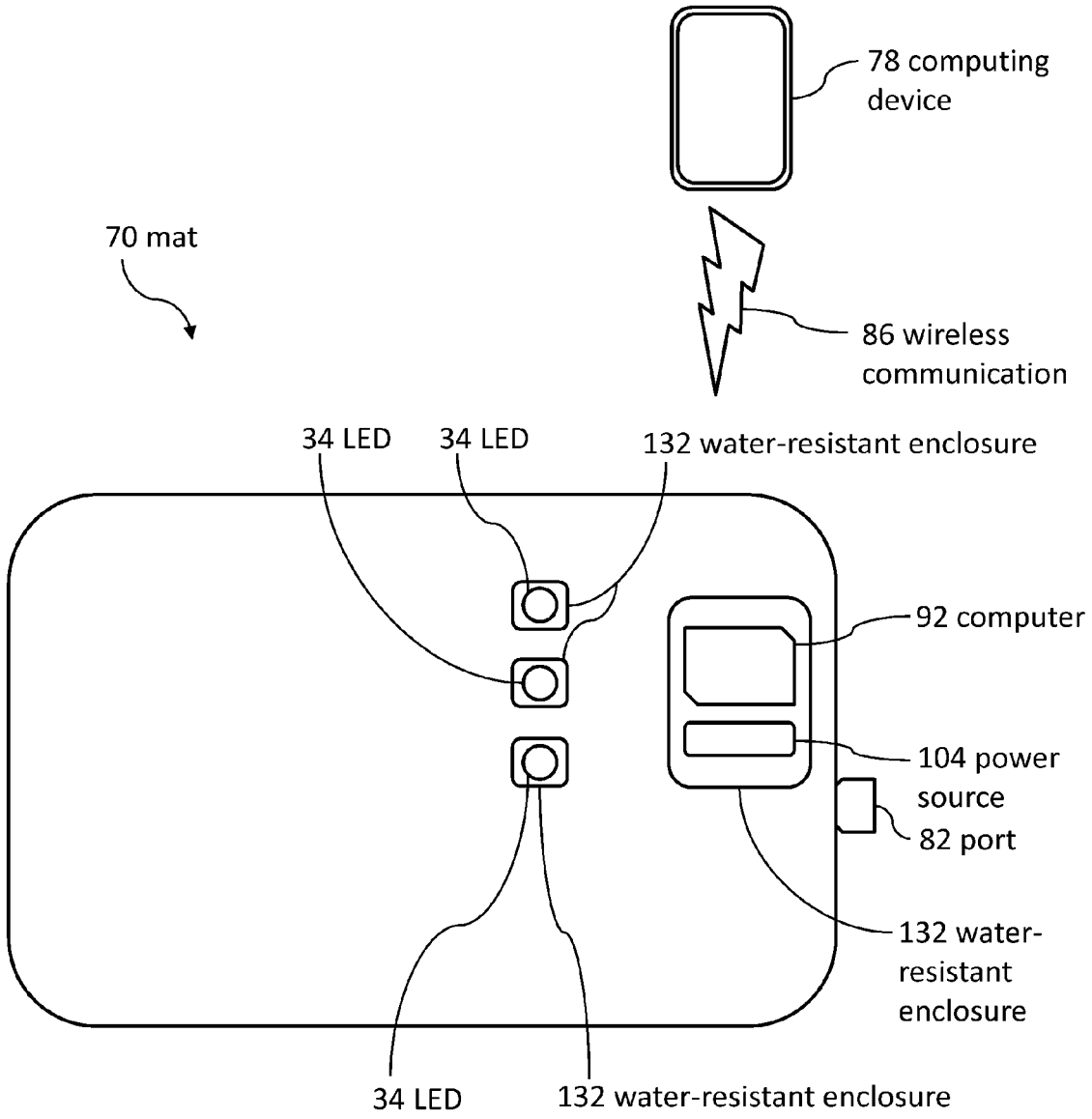

FIG. 7 illustrates a top view of the embodiment illustrated in FIG. 5. Many items are omitted from FIG. 7 to increase the clarity of the water-resistant enclosures 132. In some embodiments, the water-resistant enclosures 132 are waterproof to protect electrical components such as lights, wireless communication devices 74, computers 92, memories 96, power sources 104, microphones 108, speakers 112, motion sensors 116, and pressure sensors 122 (shown in FIG. 6) from wet environments which may be caused by a person with wet feet stepping onto mats.

Water-resistant enclosures include many diverse embodiments. In some embodiments, electrical components are encased in silicone, rubber, glass, or plastic to impede water or other fluids from reaching the electrical components. In some embodiments, water-resistant enclosures are formed by structures that block drips from reaching the electrical components similarly to how umbrellas block falling rain. In several embodiments, water-resistant enclosures are made by forming a plastic shell with an o-ring seal. O-rings can be made of rubber. Conductive wires and cables can be made water-resistant by coating the wires and cables with a plastic sleeve. Holes necessary to pass conductors into enclosures can be sealed by adhesive to make the enclosures water resistant.

Figure 8:
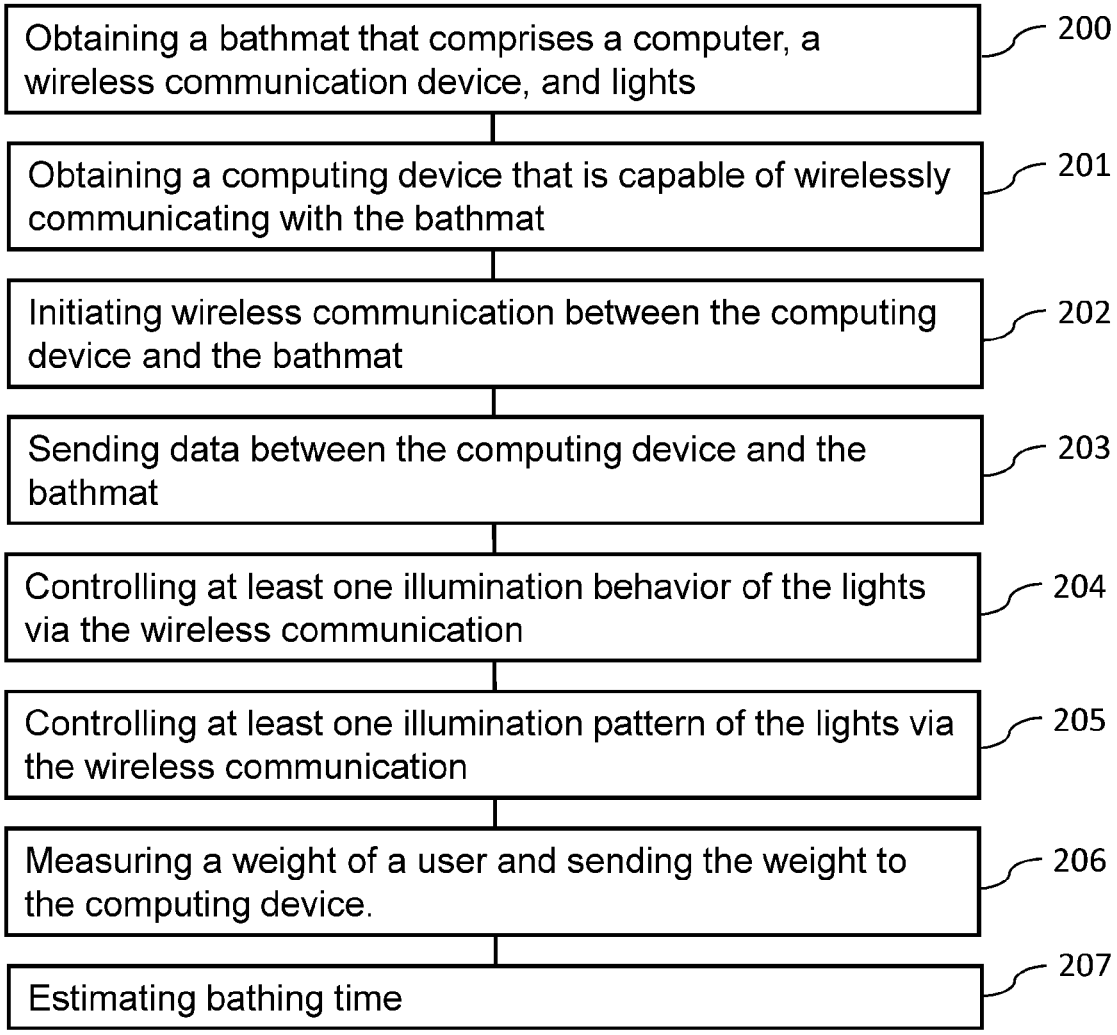
FIGS. 8 and 9 illustrate various elements that are present in several method embodiments.

FIG. 8 illustrates various elements that are present in several method embodiments described herein. Steps 200-207 include optional steps and steps that can be performed in different orders than illustrated. Step 200 can include obtaining a bathmat that comprises a computer, a wireless communication device, and lights. Step 201 can include obtaining a computing device that is capable of wirelessly communicating with the bathmat. Step 202 can include initiating wireless communication between the computing device and the bathmat. Step 203 can include sending data between the computing device and the bathmat. Step 204 can include controlling at least one illumination behavior of the lights via the wireless communication. Step 205 can include controlling at least one illumination pattern of the lights via the wireless communication. Step 206 can include measuring a weight of a user and sending the weight to the computing device. Step 207 can include estimating bathing time.

Figure 9:
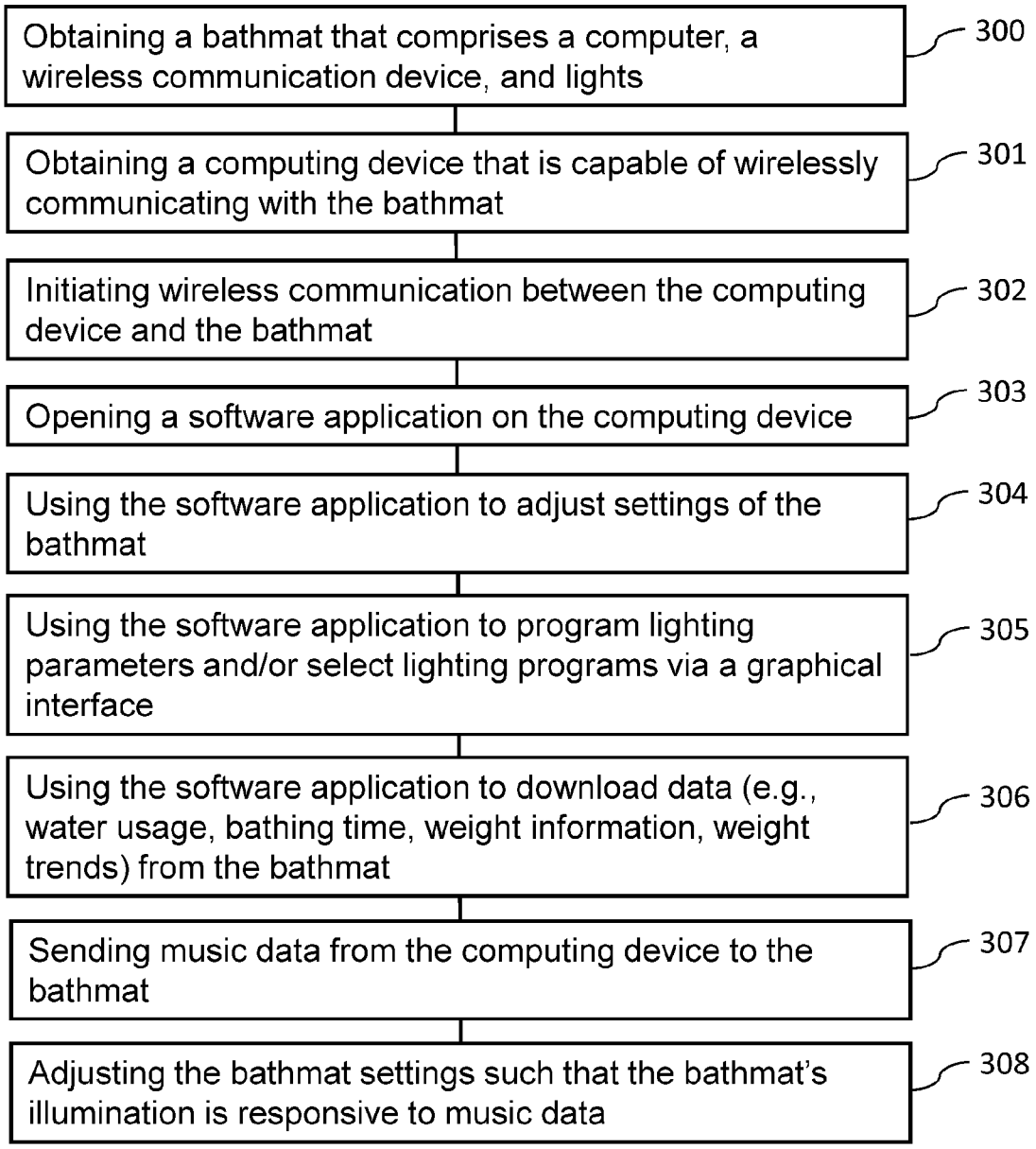

FIG. 9 illustrates various elements that are present in several method embodiments. Steps 300-308 include optional steps and steps that can be performed in different orders than illustrated.

Step 300 can include obtaining a bathmat that comprises a computer, a wireless communication device, and lights, wherein the lights can form a display to show words, pictures, and videos. Step 301 can include obtaining a computing device that is capable of wirelessly communicating with the bathmat. Step 302 can include initiating wireless communication between the computing device and the bathmat. Step 303 can include opening a software application on the computing device. Step 304 can include using the software application to adjust settings of the bathmat. Step 305 can include using the software application to program lighting parameters and/or select lighting programs via a graphical interface. Step 306 can include using the software application to download data (e.g., water usage, bathing time, weight information, weight trends) from the bathmat. Step 307 can include sending music data from the computing device to the bathmat. The music data can include the actual music, portions of the music, or data that is related to the music such as electrical signals at least partially based on the music or related to the music. Step 308 can include adjusting the bathmat settings such that the bathmat's illumination is responsive to music data. In one responsive embodiment, the bathmat's illumination is at least partially responsive to the music's volume, tempo, beat, or style.

The drawings are not necessarily to scale. The scale of some items in various drawings was altered in the interest of clarity.

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

Some of the embodiments and processes use computers. Each of the routines, processes, methods, and algorithms described in the preceding sections may be embodied in, and fully or partially automated by, code modules executed by one or more computers, computer processors, or machines configured to execute computer instructions. The code modules may be stored on any type of non-transitory computer-readable storage medium or tangible computer storage device, such as hard drives, solid state memory, flash memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

The various features and processes described above may be used independently of one another, or may be combined in various ways. All possible combinations and subcombinations are intended to fall within the scope of this disclosure. In addition, certain method, event, state, or process blocks may be omitted in some implementations. The methods and processes described herein are also not limited to any particular sequence, and the blocks or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, act, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

I claim:

1. A bathmat comprising:

a first light located inside a first water-resistant enclosure, a second light located inside a second water-resistant enclosure, and a third light located inside a third water-resistant enclosure;

a controller located inside a fourth water-resistant enclosure and configured to control illumination of the lights;

a power source located inside a fifth water-resistant enclosure and configured to provide electrical power to the lights and the controller;

an audio sensor located inside a sixth water-resistant enclosure; and a mat configured to mechanically couple the lights, the controller, the power source, and the audio sensor;

wherein the controller is configured to control illumination of the lights based at least in part on audio data received by the audio sensor.

2. The bathmat of claim 1, further comprising a pressure sensor coupled to the mat and configured to communicate with the controller.

3. The bathmat of claim 1, further comprising pressure sensors coupled to the mat, wherein the mat comprises a top surface and each pressure sensor is configured to respond to pressure on at least a portion of the mat and to send data related to pressure to the controller, and the bathmat is configured to sense pressure on at least thirty percent of the top surface.

4. The bathmat of claim 1, further comprising a timer, wherein the bathmat is configured to trigger an alert if more than a predetermined time has passed and the alert comprises emitted light, sound, or haptic feedback.

5. The bathmat of claim 1, further comprising an electrical port coupled to the mat, the electrical port is configured to couple the bathmat to a computing device located remotely relative to the bathmat to facilitate data transmission from the computing device to the bathmat or from the bathmat to the computing device.

6. The bathmat of claim 1, wherein at least two of the first water-resistant enclosure, the second water-resistant enclosure, the third water-resistant enclosure, the fourth water-resistant enclosure, and the fifth water-resistant enclosure are part of a single water-resistant enclosure.

7. The bathmat of claim 1, wherein the bathmat further comprises a motion sensor, and wherein the controller is configured to control illumination of the lights based at least in part on motion detected by the motion sensor.

8. The bathmat of claim 1, wherein the first light comprises a first light-emitting diode, the second light comprises a second light-emitting diode, and the third light comprises a third light-emitting diode.

9. A bathmat comprising:

a first light, a second light, and a third light;

a computer configured to control illumination of the lights;

a power source configured to provide electrical power to the lights and the computer;

an audio sensor;

a mat configured to mechanically couple the lights, the computer, the power source, and the audio sensor; and a wireless communication device coupled to the mat, wherein the wireless communication device is capable of wirelessly communicating with a computing device located remotely relative to the bathmat, and wherein the computer is configured to control illumination of the lights based at least in part on audio data detected by the audio sensor.

10. The bathmat of claim 9, further comprising software configured to be executed on the remote computing device and configured to set at least two illumination parameters of the bathmat.

11. The bathmat of claim 10, wherein the software is configured to process audio data received by the audio sensor, and wherein the software is configured to set the at least two illumination parameters based at least in part on the audio data.

12. The bathmat of claim 11, further comprising a memory with illumination patterns, wherein the illumination patterns comprise at least three phases.

13. The bathmat of claim 9, further comprising a pressure sensor coupled to the mat.

14. The bathmat of claim 13, wherein the bathmat is configured to weigh a person who steps onto the bathmat.

15. The bathmat of claim 9, further comprising a speaker coupled to the mat.

16. A method for controlling a bathmat, the method comprising:

obtaining a bathmat that comprises a computer, a wireless communication device, and lights;

obtaining a computing device that is capable of wirelessly communicating with the bathmat;

initiating wireless communication between the computing device and the bathmat;

sending audio data between the computing device and the bathmat; and causing, based at least in part on the audio data, a change in at least one illumination behavior of the lights via the wireless communication.

17. The method of claim 16, wherein the change in the at least one illumination behavior of the lights comprises at least one of pulsing the lights, adjusting a light intensity, adjusting a color, or displaying a pattern.

18. The method of claim 16, wherein the change in the at least one illumination behavior of the lights corresponds to at least one of a volume, a tempo, or an audio frequency.

19. The method of claim 16, wherein the bathmat further comprises an audio output device, and wherein the method further comprises causing the bathmat to output, via the audio output device, audio corresponding to the audio data.

20. The method of claim 16, further comprising estimating bathing time.

* * * * *